US007732701B2

(12) United States Patent
Miki et al.

(10) Patent No.: US 7,732,701 B2
(45) Date of Patent: Jun. 8, 2010

(54) ELECTRONIC MUSICAL INSTRUMENT

(75) Inventors: Junichi Miki, Hamamatsu (JP); Takahiro Sugizaki, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 529 days.

(21) Appl. No.: 11/828,205

(22) Filed: Jul. 25, 2007

(65) Prior Publication Data

US 2009/0025541 A1 Jan. 29, 2009

(51) Int. Cl.
*G10H 1/00* (2006.01)
*G10H 1/18* (2006.01)
*G10H 7/00* (2006.01)

(52) U.S. Cl. ..... 84/615; 84/654

(58) Field of Classification Search ..... 84/615, 84/654, 635, 622, 626, 634, 610, 611
See application file for complete search history.

(56) References Cited

U.S. PATENT DOCUMENTS 4,854,209 A 8/1989 Matsubara et al.
4,947,724 A 8/1990 Hirano et al.
4,957,032 A 9/1990 Hirano et al.
5,288,941 A * 2/1994 Sekizuka ..... 84/615
5,406,023 A * 4/1995 Nagahama ..... 84/622
5,461,191 A * 10/1995 Kondo et al. ..... 84/615
6,376,760 B1 * 4/2002 Tozuka et al. ..... 84/635
6,444,889 B1 * 9/2002 Yahata ..... 84/634

FOREIGN PATENT DOCUMENTS

JP 02-074997 3/1990
JP 9-106285 4/1997

* cited by examiner

*Primary Examiner*—Jeffrey Donels
(74) *Attorney, Agent, or Firm*—Foley & Lardner LLP

(57) ABSTRACT

The electronic musical system comprises a keyboard that has a plurality of keys to designate the pitch, a key operation detector for detecting the operating state of the keyboard, set operator that can switch to the parameter setting state, parameter value input port to input the parameter values, pressed key count detector to detect the number of pressed keys, parameter setting program for setting the parameter value according to the pressed keys detected by the key operation detector. If one key being pressed is detected, then the parameter values are set to the value of the pressed key. If, however, multiple keys being pressed are detected, then the parameter values are set to the value of the multiple pressed keys and parameter output port outputs the parameter values that were set by the parameter setting program. The electronic musical instrument allows the user to intuitively set the parameter values with a effortless operation.

11 Claims, 6 Drawing Sheets

Fig. 3

Preset : 1

| Note Level | | |
|---|---|---|
| | C1 | 2 |
| | C#2 | 0 |
| | D3 | 0 |
| | D#4 | 0 |
| | E5 | 0 |
| | F6 | 5 |
| | F#7 | 5 |
| | G8 | 5 |
| | G#9 | 5 |
| | A10 | 5 |
| | A#11 | 0 |
| | B12 | 0 |
| | C13 | 0 |
| | : | : |
| | : | : |
| | C49 | 0 |
| | C#50 | 0 |
| | D51 | 0 |
| | D#52 | 0 |
| | E53 | 0 |
| | F54 | 0 |
| | F#55 | 0 |
| | G56 | 0 |
| | G#57 | 0 |
| | A58 | 0 |
| | A#59 | 0 |
| | B60 | 0 |
| | C61 | 0 |

| Note Tone | | |
|---|---|---|
| | C1 | -4 |
| | C#2 | 0 |
| | D3 | 0 |
| | D#4 | 0 |
| | E5 | 0 |
| | F6 | 2 |
| | F#7 | 2 |
| | G8 | 2 |
| | G#9 | 2 |
| | A10 | 2 |
| | A#11 | 0 |
| | B12 | 0 |
| | C13 | 0 |
| | : | : |
| | : | : |
| | C49 | 0 |
| | C#50 | 0 |
| | D51 | -1 |
| | D#52 | -2 |
| | E53 | -3 |
| | F54 | -4 |
| | F#55 | -5 |
| | G56 | -4 |
| | G#57 | -3 |
| | A58 | -2 |
| | A#59 | -1 |
| | B60 | 0 |
| | C61 | 0 |

| Note Tune | | |
|---|---|---|
| | C1 | 3 |
| | C#2 | 0 |
| | D3 | 0 |
| | D#4 | 0 |
| | E5 | 0 |
| | F6 | -1 |
| | F#7 | -1 |
| | G8 | -1 |
| | G#9 | -1 |
| | A10 | -1 |
| | A#11 | 0 |
| | B12 | 0 |
| | C13 | 0 |
| | : | : |
| | : | : |
| | C49 | 0 |
| | C#50 | 0 |
| | D51 | 1 |
| | D#52 | 2 |
| | E53 | 3 |
| | F54 | 4 |
| | F#55 | 5 |
| | G56 | 4 |
| | G#57 | 3 |
| | A58 | 2 |
| | A#59 | 1 |
| | B60 | 0 |
| | C61 | 0 |

| Note | | Preset 1 |
|---|---|---|
| Level: | 2 | |
| Tone: | -4 | Target |
| Tune: | 3 | C1 |

Fig. 4 (a)

| Range | | Preset 1 |
|---|---|---|
| Level: | 5 | |
| Tone: | 2 | Target |
| Tune: | -1 | F6 : A10 |

Fig. 4 (b)

| Anchor | | Preset 1 | | |
|---|---|---|---|---|
| Level: | 0 | | | |
| Tone: | -5 | Low | Target | High |
| Tune: | 5 | C#50 | F#55 | B60 |

Fig. 4 (c)

ELECTRONIC MUSICAL INSTRUMENT

BACKGROUND

1. Field of the Invention

The current disclosure relates to electronic musical instruments and in particular, to instruments with the ability to set the parameter values for a plurality of keys with an effortless operation.

2. Description of Related Art

Currently, electronic musical instruments are capable of detecting operation of the keys that are on a keyboard. Musical tones are generated and silenced according to the key operations that have been detected. These kinds of electronic musical instruments assign a key number to each key and store the parameter values that correspond to each key number. When a key has been operated, the parameter values that correspond to the key number are output to a sound generator. The sound generator forms the musical tone in conformance with these parameter values.

Other electronic musical instruments can change the timbre of the musical tones throughout the entire keyboard. Initially, the parameter values that correspond to the key numbers of six locations are stored. When a key without stored parameter values is pressed, the parameter values of the neighboring keys (on each side) with stored parameter values are used. The parameter values, for the pressed key are computed by linear interpolation and those parameter values are sent to the sound generator.

The electronic musical instrument described above provides a set of parameter values for each key, these values are set through a plurality of parameter setting modes, such as, a note mode, a range mode and an anchor rubber band mode. First, the note mode, allows a user to set the parameter values that correspond to one key. Next, the range mode, allows a user to set the parameter values that correspond to two keys. Lastly, the anchor rubber band mode, allows a user to set the parameter values that correspond to three keys. In order to set these values the user can select the parameter setting mode and subsequently, set the parameter values within the corresponding mode.

However, a user may be required to select the plurality of parameter setting modes which can be an inconvenient process. In particular, when a user needs to select a different parameter setting mode, selecting of the parameter setting mode, the designation of keys to be set the parameters and the input operation for the parameter values must be repeated and doing so can be time consuming and inconvenient.

SUMMARY OF THE DISCLOSURE

The present disclosure takes into consideration the various kinds of electronic music systems of the past, such as those described above. A first objective of the electronic musical instrument is to solve the problems discussed above by providing an electronic musical instrument that allows for intuitively setting the parameter values with an effortless operation.

For electronic musical instruments, such as a piano or an organ, it can be beneficial to provide a capability for easy adjustment of the timbre, volume and pitch for each key. Embodiments of the present invention relate to methods and systems for providing such capabilities. According to certain embodiments of the present invention, a user may change between the following two states: (i) a state to use the keyboard to generate musical tones, and (ii) a state to use the keyboard to designate a range to adjust the volume, etc.

In addition, the user may easily change between one or more of the following three modes to modify parameters: 1. Note mode: a mode wherein the user can adjust parameters for each key directly; 2. Range mode: a mode wherein the user can set an identical value to all keys between two designated keys; and 3. Anchor rubber band mode: a mode wherein the user sets a rubber band between a key of the lowest pitch and a key of the highest pitch in the three designated keys and fixes the rubber band by anchors at both ends and can modify parameters by picking up the middle of the rubber band, and moving it. In this way, the user can smoothly and easily edit parameter values from key to key.

In order to achieve the above mentioned objectives, one embodiment of the electronic musical system comprises a keyboard with a plurality of keys to designate the pitch, key operation detection means for detecting the operating state of the keyboard, set operator that can switch to the parameter setting state, parameter value input means to input the parameter values, pressed key count detection means to detect the number of pressed keys, and parameter setting means for setting the parameter value according to the pressed keys detected by the key operation detection means. If the pressed key count detection means detected one key being pressed then the parameter values are set by the parameter value input means to the value of the pressed key. If, however, the pressed key count detection means detects multiple keys being pressed then the parameter values are set by the parameter value input means to the value of the pressed keys. The parameter output means outputs the parameter values that are set by the parameter setting means.

In accordance with one embodiment of the electronic musical instrument as described above, the operating states of the keys of the keyboard are detected and the parameter setting state is selected by the set operator. When the parameter setting state is selected, the pressed key count, which is the number of keys that have been pressed is detected by the pressed key count detection means and the parameter values are input by the parameter value input means. If the pressed key count that has been detected by the pressed key count detection means is one, the parameter values that have been input by the parameter value input means are set for the key that has been pressed. However, if the pressed key count is greater than one, the parameter values are set for the keys that have been pressed and for the keys that have not been pressed based on the parameter values that have been input by the parameter value input means. Next, the parameter values that have been set for each of the keys by the parameter setting means are output by the parameter output means. Therefore, the user, by operating the set operator and by pressing the keys of the keyboard, is able to select either the setting mode that carries out the settings for one key or the setting mode that sets the parameter values for a plurality of keys. Thus, it is possible to designate the keys that are used for the setting of the parameter values. Accordingly, the user need not designate the mode in which the parameters are set and the key which should set the parameters, one by one.

In yet another embodiments, if the pressed key count is more than one, the parameter values are set for the plurality of keys that have been pressed and for the keys that are positioned between the keys that have been pressed. Therefore, it is made possible for the user to set the parameter values of the keys that have been pressed and of the keys located between the pressed keys, with an easy operation, without the necessity for setting the respective parameters for each key.

In accordance another embodiment, when the pressed key count is greater than one, the parameter values are set for the plurality of keys that have been pressed. For the keys that are between the pressed keys, an interpolation computation is carried out on the set parameter values. Thus, the user may not set the parameter values for the keys that have not been pressed, and the user can save time and effort.

In another embodiment, when the pressed key count is three or more, three of the keys that have been pressed are selected. The parameter values are set for any of the three keys. The three keys as the first key, the second key, and the third key are arranged in order of lowest to highest pitch. Next, an interpolation computation is carried out based on the parameter values that have been set for the first key and the second key. The parameter values that are derived from the interpolation computation are used for the keys between the first key and the second key. Another interpolation computation is carried out based on the parameter values for the second key and the third key. The parameter values that are derived from the interpolation computation are set for the keys between the second key and the third key. This process allows a user to select any three keys on the keyboard and, by setting the respective parameter values for those keys, to also set the parameter values that support all the keys from the first key through the third key.

In yet another embodiment, the electronic musical instrument uses a display means to display the information related to the pressed keys and the parameter values that correspond to those pressed keys. This allows the user to ascertain the information for the keys that have been displayed and the parameter values that have been set.

BRIEF DESCRIPTION OF THE DRAWINGS

FIG. 3 is an example in which an outline of the parameter values that are set to the keyboard have been shown.

FIG. 4 shows an example of the setting screen for the setting of the parameter values.

DETAILED DESCRIPTION OF VARIOUS EMBODIMENTS

Figure 1:
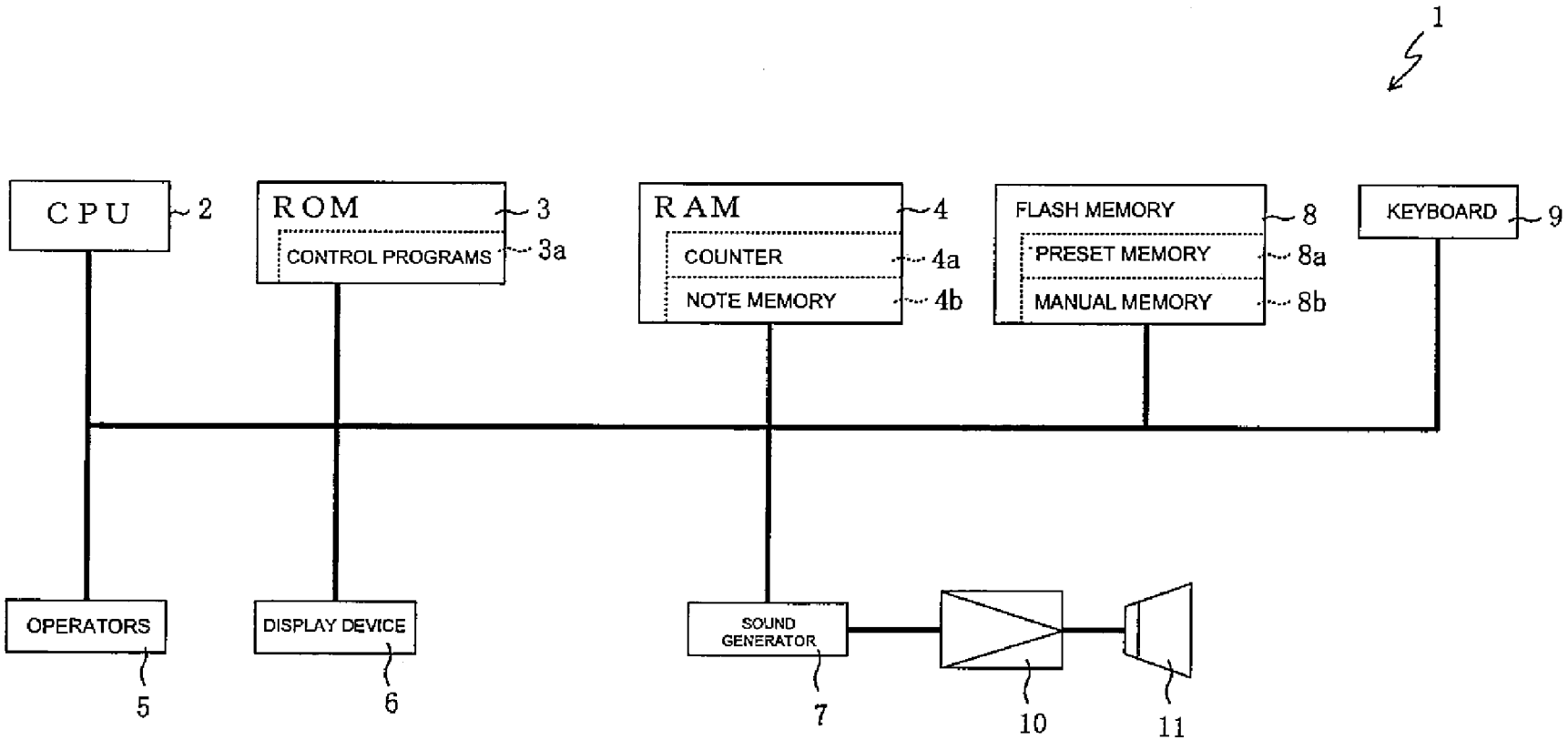
FIG. 1 is a block diagram that shows the electrical configuration of the electronic musical instrument of one embodiment.

FIG. 1 shows a block diagram depicting the electrical structure of an embodiment. The electronic musical instrument is equipped with a CPU 2, a ROM 3, a RAM 4, a operators 5, a display device 6, a sound generator 7, a flash memory 8, a keyboard 9, a amplifier 10, and a speaker 11. The CPU 2, the ROM 3, the RAM 4, the operators 5, the display device 6, the sound generator 7, the flash memory 8, and the keyboard 9 that are mutually connected via any form of electrical connection, for example, a bus line or wiring. The output of the sound generator 7 can be connected to the input of the amplifier 10, and the output of the amplifier 10 can be connected to the speaker 11.

The CPU 2 controls the electronic musical instrument 1 in accordance with each type of control signal that can be transmitted via the bus line for the fixed values and program expressions that are stored in ROM 3, RAM 4, and flash memory 8. The ROM 3 can be a non-rewritable memory that stores control program 3*a*. CPU 2 executes the control program 3*a* and the fixed value data that is referred to at the time of the execution is stored in the ROM 3. The RAM 4 can be a rewritable memory for the temporary storage of the control programs 3*a*, when they are executed by the CPU 2. The RAM 4 stores the counter 4*a* and the note memory 4*b*. When the set button 5*a* of the operators 5 has been pressed down, the counter 4*a* counts the number of keys that have been pressed and the note memory 4*b* stores the keys that have been pressed.

Figure 2:
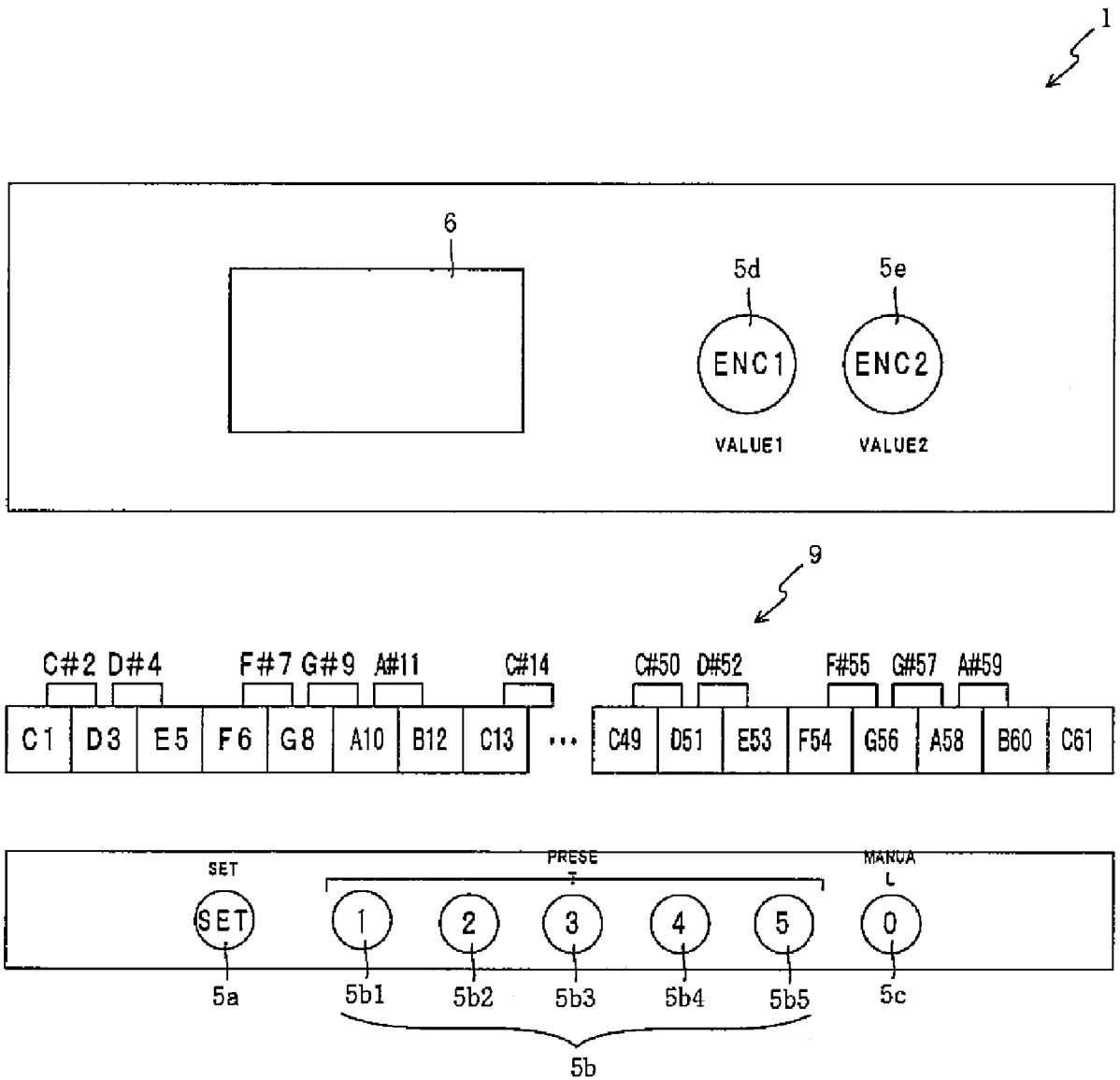
FIG. 2 is a front schematic drawing of the electronic musical instrument.

The operator 5 comprises, a plurality of operators for setting each type of parameter and will be discussed in greater detail below, while referring to FIG. 2. The display device 6 is a liquid crystal display (LCD) that displays any type of information for the electronic musical instrument 1. The display device 6 can display: the setting mode that has been selected, the keys that have been pressed, the parameter values that have been set to the keys, and the like. The functionality of the display device 6 will be discussed in greater detail below, while referring to FIG. 4.

The sound generator 7 forms the musical tones in conformance with the operation of the keyboard 9. Sound generator 7 stores the waveforms of each type of instrument (for example, but not limited to, piano, flute, violin, and the like), and the sound generator 7 also forms the musical tones in accordance with those waveforms. In addition, parameter values such as the volume, timbre, pitch, and the like are initially set for each key and the musical tones are formed based on the parameter values that have been set.

The flash memory 8 can be a non-volatile memory that may be rewritten, and the data that has been stored is retained even after the power is turned off. The flash memory 8 is furnished with the preset memory 8*a* that stores a plurality of presets. The preset memory 8*a* contains a combination of parameter values initially that correspond to each key. The manual memory 8*b* is used for the storage of manual settings.

In addition, the keyboard 9 is a keyboard for use with a musical instrument that has a plurality of white keys and black keys. The keys designate the pitch of the musical tones that are generated. The pressing of a key starts the production of the musical tone and the releasing of a key ends the production of the musical tone. When a performance is performed on the keyboard 9, the musical tones are formed by the sound generator 7 and output to the amplifier 10. The amplifier 10 amplifies the musical tone that has been generated by the sound generator 7 and the speaker 11 emits the musical tone that has been amplified by the amplifier 10.

Next, a detailed explanation will be given regarding the operators 5 and the keyboard 9 of the electronic musical instrument 1 while referring to FIG. 2. FIG. 2 is a schematic drawing of the electronic musical instrument 1. As is shown in FIG. 2, the rectangles that are indicated by C1 through C61 are drawings viewed from the front of the keys in the direction of the length. The keys without a "#" are the white keys while the keys with a "#" indicate the black keys.

Next, the display device 6 can be on the operating panel above the keyboard 9 or may be located within arms length of the keyboard 9. Also, near the display device 6, the first encoder (ENC 1) 5*d* for the selection of the type of parameter and the second encoder (ENC 2) 5*e* for modifying the values of the parameters.

Moreover, below the keyboard 9 there is a plurality of button sets. The set button 5*a* switches and sets the parameter setting state and the normal performance state. The preset button 5*b* is used for selecting the presets that have been set in advance, and the manual button 5*c* selects the timbre and the like that have been set manually.

Each key of the keyboard 9 has an identification number (hereinafter, referred to as the "note number"). The note numbers are configured by a combination of the letters (C, D, E, F, G, A, and B) that are appended matching the note names of the keys, the half note code (#), and the key numbers that have been appended with the key on the left end of the keyboard 9, going in order toward the right. Since the key on the left end in FIG. 2 has the note name C and is the first key from the left end, the note number that is appended is C1. Since the key that is adjacent to this key on the upper right has the note name of C# and is the second key from the left end, the note number that is appended is C#2. Following that sequence, the note numbers are appended in the same manner as is shown in FIG. 2. The keyboard 9, in this example, is configured using 61 keys, and since the key on the right end has the note name of C and is the 61st key from the left end, the note number is C61.

The preset button 5*b* includes five preset buttons from the first preset button 5*b*1 through the fifth preset button 5*b*5. It is possible to register a timbre and the parameter values that correspond to each key of the keyboard 9 to the respective buttons in advance. If any of the buttons is selected, the parameter values that correspond to that button are read out from the preset memory 8*a* and set in the sound generator 7.

The manual button 5*c* allows an operator to manually sets the timbre and other parameter values. The parameter values that correspond to each of the keys of the keyboard 9 can be stored in the manual memory 8*b*. When manual button 5*c* has been selected, the parameter values that have been stored in the manual memory 8*b* are read out and set in the sound generator 7.

The preset memory 8*a* of the flash memory 8, is used to store the set parameter values, such as, but not limited to, the timbre, the three parameter values of the volume, the timbre, and the pitch that correspond to the note numbers of each key. When a button of the preset buttons 5*b* is selected, the parameter values, that are stored in the preset memory 8*a*, that correspond to the selected button are set in the sound generator 7. In addition, the three parameter values of volume, timbre, and pitch that correspond to the note number of each key are stored in the manual memory 8*b*. When the manual button 5*c* is selected, the parameter values that are stored in the manual memory 8*b* are set in the sound generator 7.

When the parameter values are set in the sound generator 7 and a key is pressed, the note number of the key that has been pressed is detected and an instruction is transmitted to the sound generator to generate a musical tone. Next, the sound generator 7 receives the instruction for the note number and the start of the musical tone generation, the musical tone that corresponds to the note number is formed based on the parameter values that have been set corresponding to the note number. When the key that is being pressed is released, the note number of the key that has been released is detected and an instruction is transmitted to the sound generator 7 to stop the musical tone of the note number. Next, the sound generator 7 receives the instruction for the note number and the tone silencing, the sound generator stops the generation of the musical tone.

Next, the features of the set button 5*a* will be discussed. When set button 5*a* is not pressed, the electronic musical instrument 1 is in the performance state. However, when set button 5*a* is pressed, the parameter setting state is selected. In the parameter setting state, it is possible to set the respective parameter values for a plurality of keys that configure the keyboard 9. When a key is pressed in the parameter setting state, the pressed key count is calculated by counter 4*a* and the note number of the pressed key is stored in note memory 4*b*. The note number and the parameter values and the like are displayed on the display device 6 (refer to FIG. 4). In addition, it is possible to operate the first encoder 5*d* and the second encoder 5*e* and set the parameter values. The parameter setting method, this will be discussed in greater detail below.

Next, an explanation will be given regarding the parameter values that can be set for each key in the keyboard 9. FIG. 3 shows an outline of the parameter values of the volume (Note Level), the timbre (Note Tone), and the pitch (Note Tune) that can be set for each note number. One example of the parameter values are the registered values of the first preset button 5*b*, that are stored in the preset memory 8*a*.

Next, the parameter values of the volume, the timbre, and the pitch are respectively expressed using a plurality of bits and can be any value from the minimum value of "−64" to the maximum value of "63" (decimal). The base values for the volume, the timbre, and the pitch are initially set for each note number, matching the note name. When the parameter value is "0," the musical tone is formed using the base value. It is possible for the operator to carry out minute adjustments of the musical tone by modifying each of the parameter values in the parameter setting state.

The parameter value for the volume sets the degree of amplification of the musical tone. When this parameter value has been increased, the amplification becomes greater, likewise when the value has been decreased, the amplification is reduced. In addition, the parameter value for the timbre is one that sets the cutoff frequency of the low-pass filter through which the musical tone is passed. When this parameter value has been increased, the cutoff frequency becomes higher, likewise when this value is decreased, the cutoff frequency becomes lower. Also, the parameter value for the pitch sets the fundamental frequency of the musical tone that is formed. When this parameter value has been increased, the fundamental frequency becomes higher, likewise when the value is decreased, the frequency becomes lower.

Next, an explanation will be given regarding the methods for setting the parameter values that are set corresponding to the note number while referring to FIG. 4. There are three modes of setting the parameter values: the note mode, the range mode and the note mode. In the note mode, one key is pressed and the parameter values are set for that key. In the range mode, two keys are pressed and the parameter values are set for the range between the two keys. In the anchor rubber band mode, three keys are pressed and the parameter values are set for each of the segments between the three keys. Any of the modes can be selected by means of an operation by the set operator.

The parameter values that are set in the parameter setting state are registered by either a preset button 5*b* or the manual button 5*c*, which are selected in the performance state. When a button from preset buttons 5*b* is selected, the parameter values are stored in the preset memory 8*a* corresponding to that button. When manual button 5*c* is selected, the values are stored in the manual memory 8*b*.

When set button 5*a* of the operators 5 is pressed, the parameter setting state is activated. In addition, when a key is pressed in the parameter setting state, the number of keys that have been pressed is calculated by the counter 4*a* and the note number of the key that has been pressed is stored in the note memory 4*b*. In the note memory 4*b*, when parameter setting state is selected, the note number of the key that has been pressed first is stored as the first key, the note number of the key that has been pressed second is stored as the second key, and the note number of the key that has been pressed third is stored as the third key. However, the third key may be a key that has a pitch that is between that of the first key and that of the second key. When set button 5*a* is released and if the value of the counter 4*a* is 1, the note mode is selected. When the value of the counter 4*a* is 2, the range mode is selected; and when the value of the counter 4*a* is 3 or greater, the anchor rubber band mode is selected. In addition, the parameter setting screen that corresponds to the mode that has been selected is displayed on the display device 6.

The parameter setting screen displays the key number for the pressed key and the screen also allows a user to set the parameters that correspond to the pressed key number. Since each mode is selected by the number of keys pressed, it is possible for the operator to intuitively set the parameter values, by selecting the parameter setting state and pressing a key without the operator having to select the mode. In addition, the setting can be selected while confirming the operation of the key. The information and the parameter values of the key is displayed on display device 6, making it possible for the operator to intuitively set the parameter values.

FIGS. 4(*a*), 4(*b*) and 4(*c*) show examples of the setting screen. In particular, FIG. 4(*a*) shows one example of the setting screen for the note mode. Similarly, FIG. 4(*b*) shows one example of the setting screen for the range mode. Lastly, FIG. 4(*c*) shows one example of the setting screen for the anchor rubber band mode. Each setting screen displays the name of the mode that has been selected, the note number of the key that has been pressed, and each parameter values for volume, timbre, and pitch.

The note mode, best shown in FIG. 4(*a*), sets the parameter values for one key. The setting screen as shown in FIG. 4(*a*) is displayed on display device 6, if key C1 has been pressed, while pressing the set button 5*a* (the value of the counter 4*a* is 1). Also displayed on display device 6 is, the name "note" of the selected mode, the name "preset 1" of the button that registers the parameter values, the note number "Target C1" of the pressed key, and the values of each parameters (Level, Tone, and Tune) that are set for the pressed key. Modifications to each parameter are accomplished by the operation of the first encoder 5*d* and second encoder 5*e* of the operator 5, after the set button has been released. The first encoder 5*d* can change the category of the parameter that is desired to be modified. The second encoder 5*e* can modify the parameter value of the category that is selected.

As shown in FIG. 4(*a*), when the volume parameter value is selected, the parameter value is surrounded by a thick frame. In addition, if the first encoder 5*d* is rotated in a clockwise direction, it is possible to change the type of parameter from volume to timbre to pitch. However, if the encoder 5*d* is rotated in a counterclockwise direction, the parameter can be changed in reverse order. In addition, when the second encoder 5*e* is rotated in the clockwise direction, the parameter value that is selected increases. When encoder Se is rotated in the counterclockwise direction, the parameter value decreases. FIG. 3 shows a particular state where an operator is in the note mode, the parameter values are set to, for example, volume (2), timbre (−4), and pitch (3), and each of the parameter values is set to the note number C1. When set button 5*a* is pressed in the particular state, each of the parameter values that have been set is registered to preset button 5*b* and each of the parameter values is set in the sound generator 7.

FIG. 4(*b*) shows an example of the setting screen for the range mode. The range mode is a parameter setting mode that is selected when two keys have been pressed while the set button 5*a* is pressed. The range mode also sets each of the parameter values for the first key, the second key, and the keys between these two keys to the same or equal values. FIG. 4(*b*) also illustrates the setting screen that is displayed on display device 6 when keys F6, A10 and the set button 5*a* (the value of counter 4*a* is 2) have been pressed.

Many of the above referenced items are displayed on display device 6. Starting with, the mode name, "range," that has been selected, the button name, "preset 1," that registers the parameter values, the note number, "Target F6:A10," the keys that have been pressed, and the value of each parameter (level, tone, and tune) that is set are displayed on the display device 6. The modification of each parameter value is accomplished in the same manner as the note mode and is carried out by the operation of the first encoder 5*d* and the second encoder 5*e*, after the set button has been released.

Furthermore, while in range mode, if the parameter values of volume (5), timbre (2), and pitch (−1) are set, as is shown in FIG. 3, each parameter value of the note numbers from F6 to A10 is set to the identical value. When the set button 5*a* is pressed in this state, each of the parameter values that have been set is registered to the preset button 5*b* and each parameter value is set in sound generator 7.

FIG. 4(*c*) illustrates an example of the setting screen for the anchor rubber band mode. The anchor rubber band mode is a parameter setting mode that is selected when three or more keys have been pressed, after pressing the set button 5*a*. The key that has been pressed first is made the first key, the key that has been pressed next is the second key, and the key that has been pressed last is made the third key. In this mode, each of the parameter values for the keys between the first key and the third key is derived by linear interpolation and set. In the same manner, each of the parameter values for the keys between the third key and the second key is derived by linear interpolation and set.

In the anchor rubber band mode, if the keys are pressed three times or more, the key that has been pressed last is made the third key. Therefore, if it desired to change the third key in the middle of the setting, it is only necessary to press the desired key and thus, avoid start setting from the beginning.

FIG. 4(*c*) illustrates the setting screen that is displayed when the C#50 has been pressed first, the key B60 has been pressed next, and the key F#55 has been pressed last. Display device 6 displays the mode name, "anchor," that has been selected, the button name, "preset 1," that registers the parameter values, the first key, "Low C#50," the second key, "B60," and the third key, "Target F#55," for the keys that have been pressed, and the values of each of the parameters (Level, Tone, and Tune) that are set to the third key. The modification of each of the parameter values is accomplished by a same procedure as the note mode or the range mode and is carried out by the operation of the first encoder 5*d* and the second encoder 5*e*, after the set button is released.

In the anchor rubber band mode, the parameter values for note number C#50 may be set to volume (0), timbre (0), and pitch (0). Next, the parameter values for B60 may be set to volume (0), timbre (0), and pitch (0) (these parameter values are set in advance of parameter setting modes, such as the note mode and the like, but they may also be set in the anchor rubber band mode. An operator who selects any of Low, High, and Target is shown those parameter values to set). The parameter values that are set here are for note number F#55. The parameter values for B60 may be set to volume (0), timbre (−5), and pitch (5). As is shown in FIG. 3, each of the parameter values that are set in the note numbers C#50, B60 and each of the parameter values that have been set in the note number F#55 become the base values. Each of the parameter values for the keys between these keys is derived by linear interpolation and set. The linear interpolation of the parameter value for timbre will be discussed first.

The parameter values for the four keys (D51, D#52, E53, and F54) are between the parameter value (0) for the timbre of the first key C#50 and the parameter value (−5) for the timbre of the third key F#55. These values are calculated so that they are applicable to a linear expression. Specifically, the amount of the change for the segment from the first key through the third key is derived, the amount of the change for one key is calculated, and the change amount is added in accordance with the relative position of each key. The amount of the change for the segment is "(−5)−0=−5" and "(−5)/5=−1" is the amount of the change per key. Since "−1" is the amount of the change per key, D51 is set to (−1), D#52 is set to (−2), E53 is set to (−3), and F54 is set to (−4).

In the same manner, when the parameter values for the four keys (G56, G#57, A58, and A#59) that are between the parameter value (−5) for the timbre of the third key F#55 and the parameter value (0) of the timbre for the second key B60 are calculated so that they are applicable to a linear expression. G56 is set to (−4), G#57 is set to (−3), A58 is set to (−2), and A#59 is set to (−1). Each parameter value, the volume and the pitch, is derived using linear interpolation and set. When the set button 5*a* is pressed in the above state, all parameter values that have been set are registered for the preset button 5*b* and each of the parameter values is set in sound generator 7.

Figure 5:
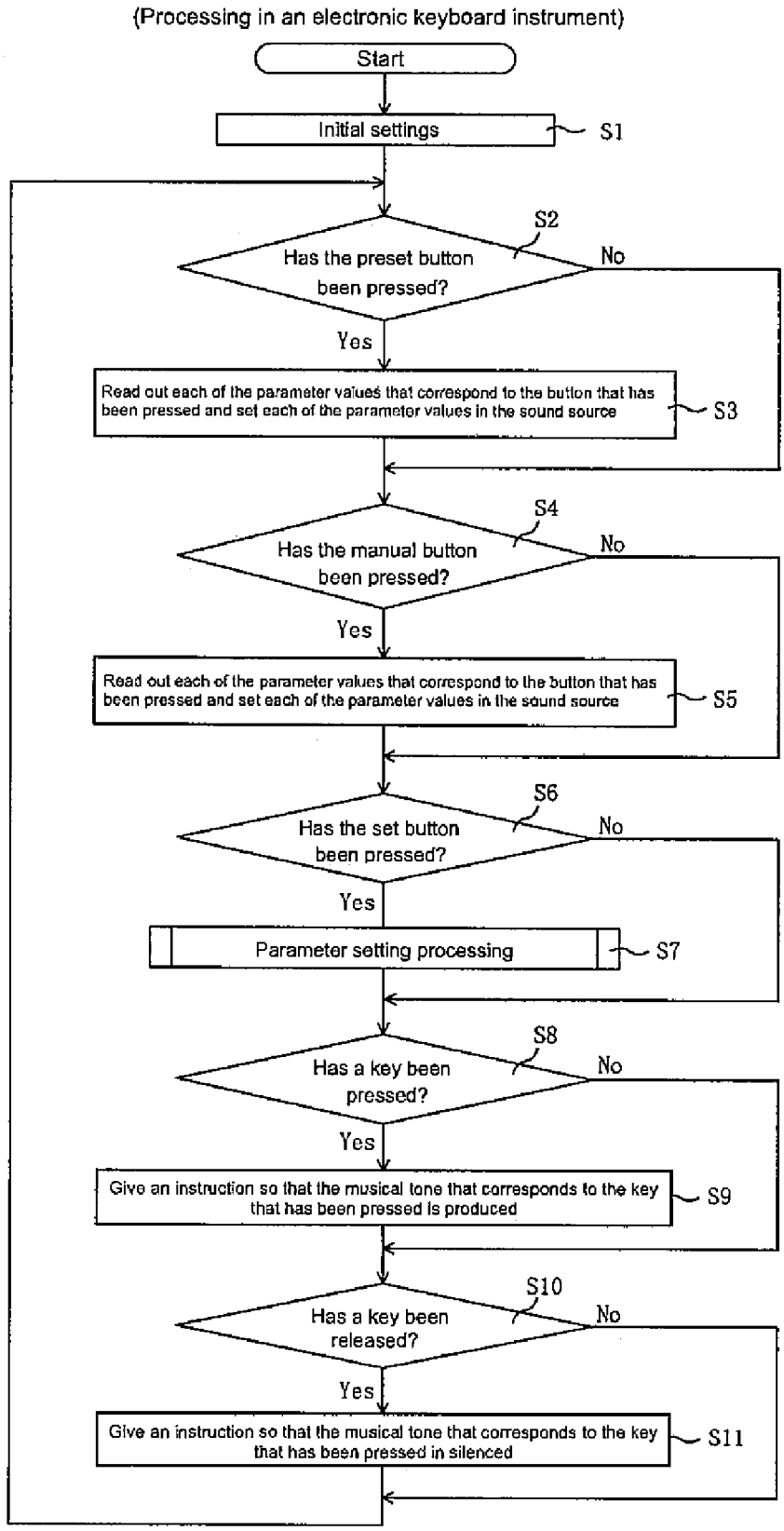
FIG. 5 is a flowchart that shows the main processing of the electronic musical instrument.
Figure 6:
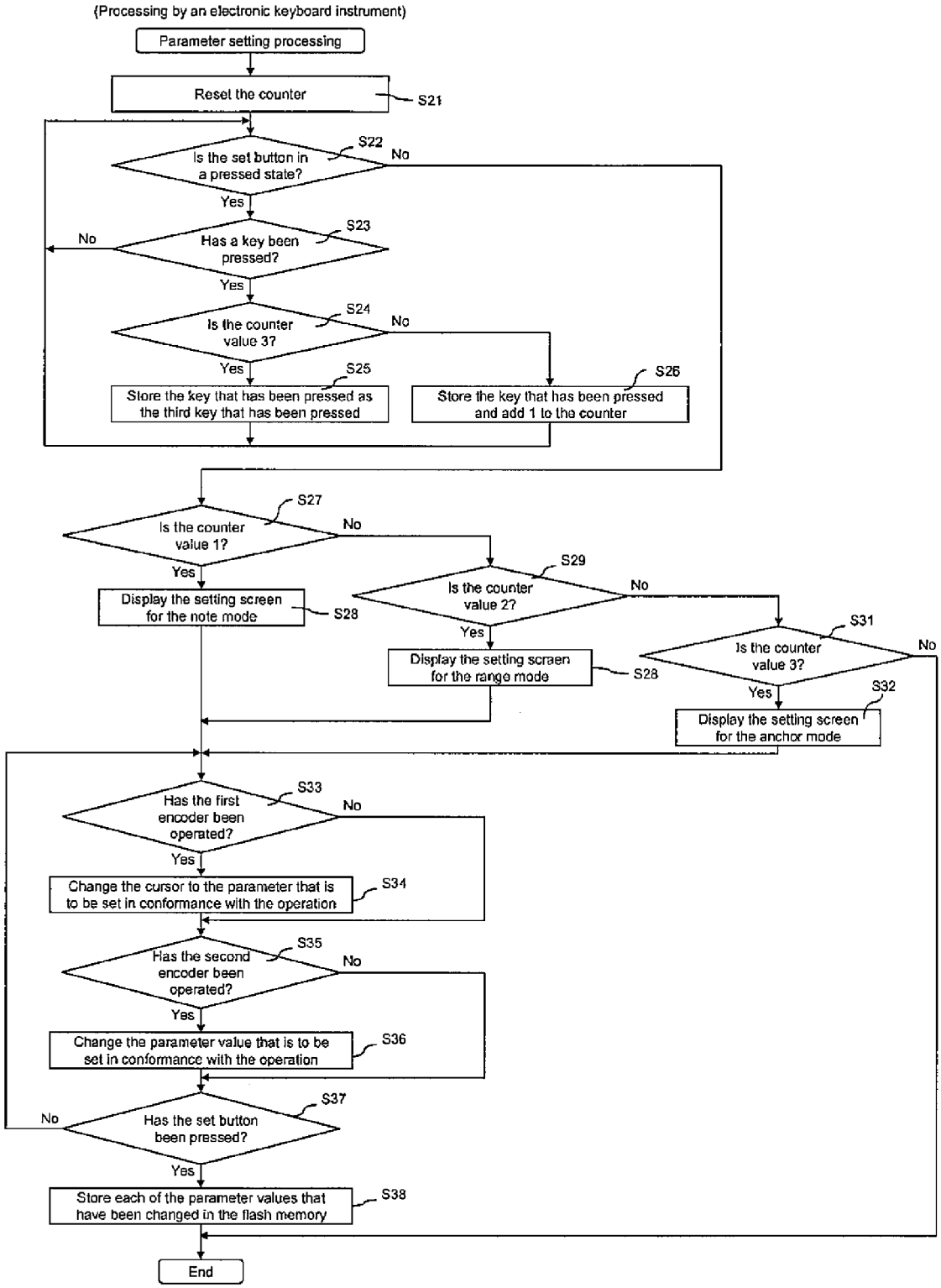
FIG. 6 is a flowchart that shows the parameter setting process of the electronic musical instrument.

FIGS. 5 and 6 demonstrate some of the processing carried out by CPU 2. Next, an explanation will be given regarding the processing that is carried out by the CPU 2. FIG. 5 is a flowchart that shows the main processing of the electronic musical instrument 1, that the processing begins when the power is turned on to the electronic musical instrument and repeatedly carried out until the power is disconnected or shut off. FIG. 6 is a flowchart that shows the parameter setting processing, that is sub-processing within the main processing.

First, an explanation will be given regarding the main processing in accordance with the flowchart that is shown in FIG. 5. The initial setting is carried out (S1). For the initial settings, RAM 4 is initialized, the processing for the initial setting of the display device 6, the sound generator 7, and the like is carried out. Next, a determination is made as to whether a preset button 5*b* has been pressed (S2). If the preset button 5*b* has been pressed (S2: yes), each parameter value is read out from the preset memory 8*a* (S3). On the other hand, when a preset button has not been pressed (S2: no), the routine shifts to the processing of S4.

Next, a determination is made as to whether the manual button 5*c* has been pressed (S4). If the manual button 5*c* has been pressed (S4: yes), then each of the parameter values is read out from the manual memory 8*b* and the values are set in the sound generator 7 (S5). On the other hand, if the manual button 5*c* has not been pressed (S4: no), the routine shifts to processing S6. Next, a determination is made as to whether the set button 5*a* has been pressed (S6). If set button 5*a* has been pressed (S6: yes), the parameter setting processing that is shown in FIG. 6 is executed (S7). On the other hand, if set button 5*a* has not been pressed (S6: no), the routine shifts to the processing of S8.

Subsequently, a determination is made as to whether a key has been pressed (S8). If the key has been pressed (S8: yes), the note number of the key that has been pressed and the like are transmitted to the sound generator 7. Also an instruction is given so that the designated musical tone is produced (S9). On the other hand, if a key has not been pressed (S8: no), the routine shifts to the processing of S10. Next, a determination is made as to whether a key has been released (S10); and if a key has been released (S10: yes), the note number of the key that has been released and the like is transmitted to the sound generator 7. An instruction is also given to halt the production of the designated musical tone (S11), and the routine returns to the processing of S2. On the other hand, while processing S10, a key has not been released (S10: no), the routine returns to the processing of S2.

Next, an explanation will be given regarding the parameter setting processing according to the flowchart that is shown in FIG. 6. In the parameter setting processing, first, the counter 4*a* is reset (S21). Then, a determination is made as to whether the set button 5*a* is in a pressed state (S22). If the set button 5*a* has been pressed (S22: yes), then a determination is made as to whether a key has been pressed (S23). On the other hand, when the set button 5*a* has not been pressed (S22: no), the routine shifts to the processing of S27.

During the processing of S23, if a key has been pressed (S23: yes), then a determination is made as to whether the value of the counter 4*a* is 3 (S24). On the other hand, if a key has not been pressed (S23: no), then the routine returns to the processing of S22. During the processing of S24, if the value of the counter 4*a* is 3 (S24, yes), then the pressed key is stored in the note memory 4*b* as the third key (S25) and the routine returns to the processing of S22. On the other hand, if the value of the counter is not 3 (S24: no), then the pressed key is stored in the note memory 4*b*, 1 is added to the value of the counter 4*a* (S26), and the routine shifts to the processing of S22. If the value of the counter 4*a* is 0, then the pressed key is stored as the first key, if the value of the counter 4*a* is 1, then the pressed key is stored as the second key, and if the value of counter 4*a* is 2, the key is stored as the third key.

In the processing of S27, a determination is made as to whether the value of the counter 4*a* is 1 (S27). If the value of the counter 4*a* is 1 (S27: yes), the setting screen of the note mode is displayed on the display device 6 (S28) and the routine shifts to the processing of S33. On the other hand, if the value of the counter 4*a* is not 1 (S27: no), then a determination is made as to whether the value of the counter 4*a* is 2 (S29). During the processing of S29, if the value of the counter 4*a* is 2 (S29: yes), then the setting screen of the range mode is displayed on the display device 6 (S30) and the routine shifts to the processing of S33. On the other hand, if the value of the counter 4*a* is not 2 (S29: no), then a determination is made as to whether the value of the counter 4*a* is 3 (S31). During the processing of S31, if the value of counter 4*a* is 3 (S31: yes), then the setting screen of the anchor rubber band mode is displayed on the display device 6 (S32) and the routine shifts to the processing of S33. On the other hand, if the value of the counter 4*a* is not 3 (S31: no), because the value of the counter 4*a* is 0, then the parameter setting processing ends.

While processing S33, a determination is made as to whether the first encoder 5*d* has been operated (S33). If the first encoder 5*d* has been operated (S33: yes), the cursor that is displayed on the display device 6 is moved in conformance with the operation and the cursor is changed to the parameter that is to be set (S34). On the other hand, if the first encoder 5*d* has not been operated (S33: no), the routine shifts to the processing of S35. Next, a determination is made as to whether the second encoder 5*e* has been operated (S35) and if the second encoder 5*e* has been operated (S35: yes), the parameter value that is set by the cursor is modified (S36), on the display device. On the other hand, if the second encoder 5*e* has not been operated (S35: no), the routine shifts to the processing of S37. Next, a determination is made as to whether the set button 5*a* has been pressed (S37); and if the set button 5*a* has been pressed (S37: yes), each of the parameter values that have been modified is stored in the flash memory 8 (S38). If the note mode has been selected, the parameter values that have been set that correspond to the pressed key are stored. If the range mode has been selected, the identical parameter values that have been set that correspond to the keys that are between the two keys are stored.

If the anchor rubber band mode has been selected, the parameter values that have been set for the third key are stored. The linearly interpolated values for the keys that are positioned between the first key and the third key, are stored. Similarly, the linearly interpolated values that are based on the parameter values that have been set for the second key and the third key are stored for the keys that are positioned between the second key and the third key.

If any of the buttons of the preset buttons 5*b* has been selected, each parameter values is stored in the preset memory 8*a* corresponding to that button. However, if the manual button 5*c* is selected, the parameter values are stored in the manual memory 8*b*. In addition, each of the parameter values is set in the sound generator 7. When the processing of S38 has ended, the parameter setting processing ends. However, during in the processing of S37, if the set button 5*a* has not been pressed (S37: no), then the routine returns to the processing of S33.

As has been explained above based on one embodiment, if any of the keys of the keyboard 9 is pressed while pressing the set button 5*a*, the pressed key count is detected and the parameter setting mode is selected according to the pressed key count. If the pressed key count is 1, the note mode is selected. The note number of the key that has been pressed is displayed on the display device 6 and the parameter values that correspond to that note number are entered. When the pressed key count is two, the range mode is selected. In the range mode, two note numbers are displayed on the display device 6 and the parameter values are set. In addition, the parameter values that have been set are set as the parameter values that correspond to the two keys and to the keys that are positioned between these two keys. In those cases where the pressed key count is three or more, the parameter values are set for the key that has been pressed last and for the keys that are positioned between the three keys using interpolation. Therefore, it is possible for the user to select the setting mode and the keys that are the object of the setting without the need to carry out such successive operations as selecting the mode in which the parameters are set and the keys that are set, by merely pressing the set button 5*a* and the keys, and the use is convenient.

Incidentally, the key operation detection means corresponds to the processing of S8 and S10 of the flowchart that is shown in FIG. 5 and S23 of the flowchart that is shown in FIG. 6. The pressed key count detection means corresponds to the processing of S25 and S26 of the flowchart that is shown in FIG. 6. The parameter setting means corresponds to the processing of S33, S34, S35, S36, and S38 of the flowchart that is shown in FIG. 6. The parameter input means corresponds to the processing of S36 of the flowchart that is shown in FIG. 6. The parameter output means corresponds to the processing of S27, S28, S29, S30, S31, and S32 of the flowchart that is shown in FIG. 6.

An explanation was given above regarding the current disclosure based on an embodiment, but the current disclosure is not in any way limited to the embodiment that has been discussed above and the possibility of various modifications and changes that do not diverge from and are within the scope of the tenor and can be easily surmised.

For example, in the embodiment described above, the range mode uses identical values for each of the parameter values of the keys that are between the first key and the second key. However, in another embodiment it is possible to set the values of the keys between the first and second key by using linear interpolation.

In addition, in the embodiment described above, the range mode is a mode in which the identical values are set for each of the parameter values of the keys that are between the first key and the second key. However, it may also be possible to set each of the parameter values for either the first key or the second key, the amount of change for each parameter value (the proportional modulus of a linear interpolation expression). Each of the parameter values for the keys that are between the first and the second keys is set based on the values that have been derived and set using linear interpolation.

In addition, in the embodiment described above, it has been programmed such that in those cases where the pressed key count is three or more, the anchor rubber band mode is set. The parameter values for this mode are set based on the three keys, the key that has been pressed first, the key that has been pressed second, and the key that has been pressed last. However, the parameter values may be set based on the total of three keys in such a manner in which there is a first pressed key and two pressed keys that have been pressed last, or such that the three keys that have been pressed last are selected and the parameter values are set with the three keys that have been selected as the first key, the second key, and the third key in the order of the pitches of the keys from the lowest to the highest.

In addition, in one embodiment described above, the anchor rubber band mode is a mode in which, using each of the parameter values of the third key, each of the parameter values is derived by interpolation and set for the keys that are between the first key and the third key. In the same manner, each of the parameter values is derived by interpolation and set for the keys that are between the third key and the second key. However, it may also be set up such that each of the parameter values is set for the first key, each of the parameter values is set for the second key, and each of the parameters is set for the third key, and based on the values that have been set, each of the parameter values is derived using interpolation and set for the keys that are between the first key, the third key and for the keys that are between the third key and the second key.

In addition, in one embodiment described above, the anchor rubber band mode is a mode in which, using each of the parameter values of the third key, each of the parameter values is derived by interpolation and set for the keys that are between the first key and the third key. In the same manner, each of the parameter values is derived by interpolation and set for the keys that are between the third key and the second key. However, it may also be set up such that each of the parameter values for the third key and the amount of the change in each of the parameter values for the keys that are between the first key and the third key as well as the amount of the change in each of the parameter values for the keys that are between the third key and the second key are set. Based on the values that have been set, each of the parameter values is derived using interpolation and set for the keys that are between the first key and the third key and for the keys that are between the third key and the second key.

In addition, in one embodiment described above, it has been set up such that at the time that the parameters of the keys that are between two keys are derived, the calculations are carried out using linear interpolation. However, it may also be set up such that in those cases where the parameter values are specified for three keys such as in the anchor rubber band mode, the interpolation is done using a function such as a quadratic function, a cubic function, or a spline function, and the like.

In addition, in one embodiment described above, it has been set up such that the parameter values for the keys that are between two keys are derived using interpolation based on the parameter values that have been set respectively to the two keys. However, the parameter values may also be set for the keys that are positioned on the outside of rather than between the two keys using extrapolation.

In addition, in one embodiment described above, it has been set up such that in those cases where any of the preset switches 5*b* or the manual switch key has been operated, the parameter values that are stored in the preset memory 8*a* that correspond to the preset switch 5*b* or the parameter values that are stored in the manual memory 8*b* are read out and transmitted to the sound generator. However, it may also be set up such that at the time of the key being pressed, the parameter values that correspond to the note number are read out from the flash memory 8 at the same time as the note number and transmitted to the sound generator.

What is claimed is:

1. An electronic musical instrument, comprising:

a keyboard that has a plurality of keys that designate a pitch;

key operation detection means for detecting the operating state of the keyboard;

a set operator that switches to a parameter setting state;

parameter value input means for inputting the parameter values;

pressed key count detection means for detecting the number of keys pressed;

parameter setting means for setting the parameter values according to the pressed keys as detected by the key operation detection means; and a parameter output means for outputting the parameter values that were set by the parameter setting means;

wherein, in the parameter setting state, the number of keys pressed is detected by the pressed key count detection means;

wherein when the pressed key count is one, the parameter values are set based on the parameter values that have been input by the parameter value input means for the pressed key as detected by the key operation detection means; and wherein when the pressed key count that has been detected by the pressed key count detection means is greater than one, the parameter values are set based on the parameter values that were input by the parameter value input means according to the keys that have been pressed as detected by the key operation detection means.

2. The electronic musical instrument of claim 1, wherein when the pressed key count that has been detected by the pressed key count detection means is a multiple number;

the parameter setting means sets the parameter values that have been input by the parameter value input means, for the plurality of keys that were pressed, and detected by the key operation detection means, wherein the parameter setting means sets the parameter values for those keys that are positioned between that plurality of pressed keys.

3. The electronic musical instrument of claim 1, wherein when the pressed key count detected by pressed key count detection means is a multiple number;

the parameter setting means sets the parameter values by using an interpolation computation based on the parameter values that have been set to the respective plurality of keys and sets the parameter values for the keys that are positioned between the plurality of keys to the values that have been derived by the interpolation computation.

4. The electronic musical instrument of claim 1, wherein when the pressed key count detected is at least three, the parameter setting means selects three keys that were pressed, and sets the parameter values to any one of the three keys;

wherein the parameter setting means sets the three keys as the first key, the second key, and the third key in order of the pitch from the lowest to the highest pitch;

wherein the parameter setting means carries out an interpolation computation based on the parameter values set for the first key and the second key, and sets the parameter values that have been derived by the interpolation computation for the keys that exist between the first key and the second key;

wherein the parameter setting means carries out an interpolation computation based on the parameters that set for the second key and the third key, and sets the parameter values that have been derived by the interpolation computation for the keys that exist between the second key and the third key.

5. The electronic musical instrument of claim 1, further comprising a display means for displaying information, wherein the display means displays information related to the key that has been detected by the key operation detection means, display means displays the parameter values that have been input by the parameter value input means that correspond to the at least one key that was pressed.

6. A method of operating an electronic musical device, comprising detecting the operating state of the keyboard that has a plurality of keys that designate a pitch;

providing set operator that switches to the parameter setting state;

inputting the parameter values;

detecting the number of keys pressed;

setting the parameter values according to the detection of the operating state of pressed keys of the keyboard; and outputting the parameter values that were set;

wherein, in the parameter setting state, the number of keys pressed is detected;

wherein when the pressed key count is one, the parameter values are set for the pressed key based on the input parameter values;

wherein when the pressed key count that has been detected is greater than one, the parameter values are set according to the keys that have been pressed as detected.

7. An electronic musical instrument operable with a keyboard having a plurality of keys to designate a pitch, a plurality of operating states, a parameter setting state and a plurality of parameter values, the instrument comprising:

key operation detector that detects the operating state of the keyboard;

a setting operator for switching to the parameter setting state for the keyboard;

a parameter value input port for inputting the parameter values;

pressed key count detector for detecting the number of keys pressed in the parameter setting state;

a parameter setting program for setting the parameter values according to the pressed keys as detected by the key operation detector; and a parameter output port for outputting the parameter values that were set by the parameter setting program.

8. The electronic musical instrument of claim 7, wherein when the pressed key count is at least two;

the parameter values are set by the parameter setting program for the plurality of keys that were pressed and parameter values are also set for the keys that are positioned between the plurality of pressed keys.

9. The electronic musical instrument of claim 7, wherein the pressed key count detected by pressed key count detector is at least two;

wherein the parameter setting program further comprising, an interpolation computation based on the parameter values that have been set to the respective plurality of keys and setting the parameter values for the keys that are positioned between the plurality of keys to the values that have been derived by the interpolation computation.

10. The electronic musical instrument of claim 7, wherein when the pressed key count detected is at least three, the parameter setting program selects three keys that were pressed, and sets the parameter values to any one of the three keys;

wherein the parameter setting program sets the three keys as the first key, the second key, and the third key in order of the pitch from the lowest to the highest pitch;

the parameter setting program further comprises, carrying out a first interpolation computation based on the parameter values set for the first key, the second key, and setting the parameter values that have been derived by the interpolation computation for the keys that exist between the first key and the second key;

the parameter setting program further comprises, carrying out a second interpolation computation based on the parameters that set for the second key and the third key, and setting the parameter values that have been derived by the interpolation computation for the keys that exist between the second key and the third key.

11. The electronic musical instrument of claim 7, further comprising a display for illustrating information;

wherein the display illustrates information related to the key that has been detected by the key operation detector;

wherein display illustrates the parameter values that have been input by the parameter value input port that correspond to the at least one key that was pressed.

* * * * *